US006527037B2

(12) United States Patent
Daus et al.

(10) Patent No.: US 6,527,037 B2
(45) Date of Patent: Mar. 4, 2003

(54) ROLLING DOOR TENSIONER

(75) Inventors: Mark Daus, Cuyahoga Falls, OH (US); Alvin R. Eiterman, Hilliard, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/858,787

(22) Filed: May 16, 2001

(65) Prior Publication Data

US 2002/0170688 A1 Nov. 21, 2002

(51) Int. Cl.[7] ..... E06B 9/56
(52) U.S. Cl. ..... 160/315; 160/133
(58) Field of Search ..... 160/315, 191, 160/192, 133, 201, 323.1, 1, 7, 9; 16/197, 198

(56) References Cited

U.S. PATENT DOCUMENTS

| | | | | | |
|---|---|---|---|---|---|
| 575,572 | A | * | 1/1897 | Parsons | 160/315 |
| 842,936 | A | * | 2/1907 | Case | 160/315 |
| 1,994,142 | A | | 3/1935 | Madsen | 20/19 |
| 2,097,242 | A | | 10/1937 | Robinson | 20/20 |
| 3,672,492 | A | * | 6/1972 | Sherr | 160/133 X |
| 3,734,161 | A | | 5/1973 | Pierce | 160/133 |
| 4,356,668 | A | | 11/1982 | Wagner | 49/506 |
| 4,472,910 | A | | 9/1984 | Iha | 49/139 |
| 4,583,706 | A | * | 4/1986 | Whitehouse et al. | 160/133 X |
| 4,597,224 | A | | 7/1986 | Tucker | 49/199 |
| 4,817,927 | A | | 4/1989 | Martin | 267/155 |
| 4,930,182 | A | | 6/1990 | Eichenberger | 16/198 |
| 4,981,165 | A | | 1/1991 | Miller et al. | 160/191 |
| 5,222,327 | A | | 6/1993 | Fellows et al. | 49/139 |
| 5,239,777 | A | | 8/1993 | Husselton | 49/200 |
| 5,253,693 | A | * | 10/1993 | Marlatt et al. | 160/315 X |
| 5,778,490 | A | | 7/1998 | Curtis | 16/198 |
| 6,155,327 | A | | 12/2000 | Wells et al. | 160/310 |
| 6,283,193 | B1 | * | 9/2001 | Finch et al. | 160/191 |

OTHER PUBLICATIONS

Wayne–Dalton Corp.'s Drawing No. 075–0274 for Inside Adjuster.
Wayne–Dalton Corp.'s Drawing No. 075–0274–2 for Inside Adjuster.
International Search Report in PCT/US02/14818 based upon USSN 09/858,787.

* cited by examiner

*Primary Examiner*—David M. Purol
(74) *Attorney, Agent, or Firm*—Renner, Kenner, Greive, Bobak, Taylor & Weber

(57) ABSTRACT

A rolling door including an axle supported by end brackets, a plurality of drum wheels mounted on the axle, a multi-section door adapted to be selectively rolled and unrolled about the drum wheels, a gear wheel mounted on the axle proximate to one of the end brackets, a spring retainer associated with the gear wheel, a torsion spring having a first end operatively attached to the multi-section door and a second end attached to the spring retainer, a pivotally mounted pawl selectively engaging the gear wheel to maintain a selected counterbalance force setting and disengaging the gear wheel to permit adjustment of the counterbalance force setting, and a locking assembly carried on the pawl selectively engageable with the support bracket to lock the pawl in an engaged position.

32 Claims, 4 Drawing Sheets

ROLLING DOOR TENSIONER

BACKGROUND OF THE INVENTION

In general, the present invention relates to a door tensioning device or tensioner. Such devices are commonly used to maintain and adjust the tension of a spring used to counterbalance the weight of an upwardly opening door. One type of upward opening door is a rolling door, which uses a curtain made of flexible material or a plurality of panels that is coiled up around itself as the door is opened. One end of the curtain is attached to steel wheels that are welded or otherwise affixed to a support axle. This support axle, often referred to as a live axle because it rotates as the door is opened, is supported and journaled at its ends by brackets attached to the header or jambs of the door. To provide a counterbalancing force for the weight of the door, a spring is attached at one end to one or more of the wheels and at its other end to a tensioning assembly. In the past, the door's support bracket would act as the tensioning assembly. In this instance, the door typically would arrive at the place of installation in its open position i.e., the curtain being completely coiled around the axle. Once the curtain and axle were mounted on the support brackets, the free end of the spring would be attached to one support bracket and the door would be rotated through one or more rotations to charge the spring. At this point, a bottom bar of the door would be inserted into vertical guides to prevent the door from rotating. Optimally, the counterbalance spring would have sufficient tension such that the door would fully close and only a small amount of force would be necessary to raise the door from the closed position. If the door is not in the optimal position, the installer would adjust the spring tension by removing the bottom bar from the guides and repositioning the end of the spring and the support bracket. After which, the installer would reassemble these components and repeat the pre-tensioning procedure to charge the spring.

To avoid repositioning of the spring on the bracket, alternative tensioning assemblies have been developed. In one such assembly, an axle tube is provided with a spring attaching plate and a tensioning plate. The tube is fitted over the axle such that these plates may move independently of the axle. The plates are located on either side of the tensioning bracket and an end of the counterbalance spring passes through the spring attaching plate to eventually attach to the bracket. With the spring so attached, the axle tube may be rotated to increase or decrease tension on the spring. All of the plates are provided with a plurality of holes located radially equidistant from the center of the axle. To maintain the tension on the spring, a pin is passed through the holes in each plate to fix the plates relative to each other and the bracket preventing rotation of the axle tube. Adjustment may be made by removing the pin and rotating the axle tube toward the next appropriate hole.

As will be appreciated, this tensioning assembly may be difficult to use. The user must rotate the axle tube with a suitable tool in one hand to align the holes in the spring attaching plate, tensioning bracket, and tension plate, and with the other hand attempt to insert a pin through these holes while maintaining the alignment. As a result, once the installer has the holes aligned, he must maintain the exact tension on the axle tube to preclude relative rotation while inserting the pin.

A further disadvantage of this system is that the slidable pin may become disengaged by efforts to tamper with the door or other accidental contact with the pin. Essentially, the pin is not axially held, but for the frictional forces created by the plates and bracket. Therefore, a person could possibly remove the pin without tools or extensive effort causing unintentional release of the spring's tension. It will be appreciated that such a release could make it difficult or impossible to operate the door and, in more dire instances, cause serious injury.

SUMMARY OF THE INVENTION

It is, therefore, an aspect of the present invention to provide a door tensioner that automatically prevents rotation of the axle tube as the installer rotates the tube to a desired position. A further aspect of the present invention is to provide a tensioning assembly that includes a gear and spring-loaded pawl to hold the axle tube at the desired position.

It is another aspect of the present invention to provide a locking assembly that locks either of the gear or pawl to the support bracket, where the locking assembly cannot be removed without extensive effort or the aid of tools. It is a further aspect of the present invention to provide a fastener supported on the pawl that may be driven into the support bracket to lock the tensioner in place.

The present invention generally provides a tensioner in a rolling door system, the rolling door system having a door attached to at least one wheel supported on an axle, the axle being rotatably supported on a pair of support brackets, the support brackets each defining a bore through which the axle is received and a counterbalance assembly that generates a counterbalancing force, the counterbalance assembly having a first end attached to the tensioner and a second end attached to the axle, the tensioner including a sleeve that fits over an end of the axle and is rotatably supported in the bore of the support bracket; a spring holder and a gear wheel attached to the sleeve, wherein the second end of the counterbalance assembly attaches to the spring holder; the gear having a plurality of teeth defining a plurality of notches therebetween; a pawl movable between a disengaged position and an engaged position, the pawl retaining the gear in a position when in the engaged position; the pawl being biased toward the engaged position, whereby the pawl automatically engages the gear to retain the counterbalancing force generated by the counterbalance assembly to balance the weight of the door.

The present invention further provides a rolling door including an axle supported by end brackets, a plurality of drum wheels mounted on the axle, a multi-section door adapted to be selectively rolled and unrolled about the drum wheels, a gear wheel mounted on the axle proximate to one of the end brackets, a spring retainer associated with the gear wheel, a torsion spring having a first end operatively attached to the multi-section door and a second end attached to the spring retainer, a pivotally mounted pawl selectively engaging the gear wheel to maintain a selected counterbalance force setting and disengaging the gear wheel to permit adjustment of the counterbalance force setting, and a locking assembly carried on the pawl selectively engageable with the support bracket to lock the pawl in an engaged position.

A rolling door including, an axle supported by end brackets, a plurality of drum wheels mounted on the axle, a multi-section door adapted to be selectively rolled and unrolled about the drum wheels, a sleeve rotatable on the axle, a gear wheel attached to the sleeve, a spring retainer associated with the gear wheel, a torsion spring having a first end attached to the multi-section door and a second end attached to the spring retainer, a pivotally mounted pawl selectively engaging the gear wheel to maintain a selected counterbalance force setting and disengaging the gear wheel to permit adjustment of the counterbalance force setting, and a locking assembly carried on the pawl selectively engageable with the support bracket to lock the pawl in an engaged position.

The present invention further provides a rolling door assembly including an axle supported by end brackets, a plurality of drum wheels mounted on the axle, and a multi-section door adapted to be selectively rolled and unrolled about the drum wheels, a tensioner associated with the axle, a torsion spring having a first end operatively attached to the multi-section door and a second end operatively attached to the tensioner, the tensioner including a gear wheel having a plurality of teeth, the teeth having an undercut stop face, and a pivotally mounted pawl selectively engaging the stop face to maintain a selected counterbalance force setting.

DETAILED DESCRIPTION OF THE INVENTION

Figure 1:
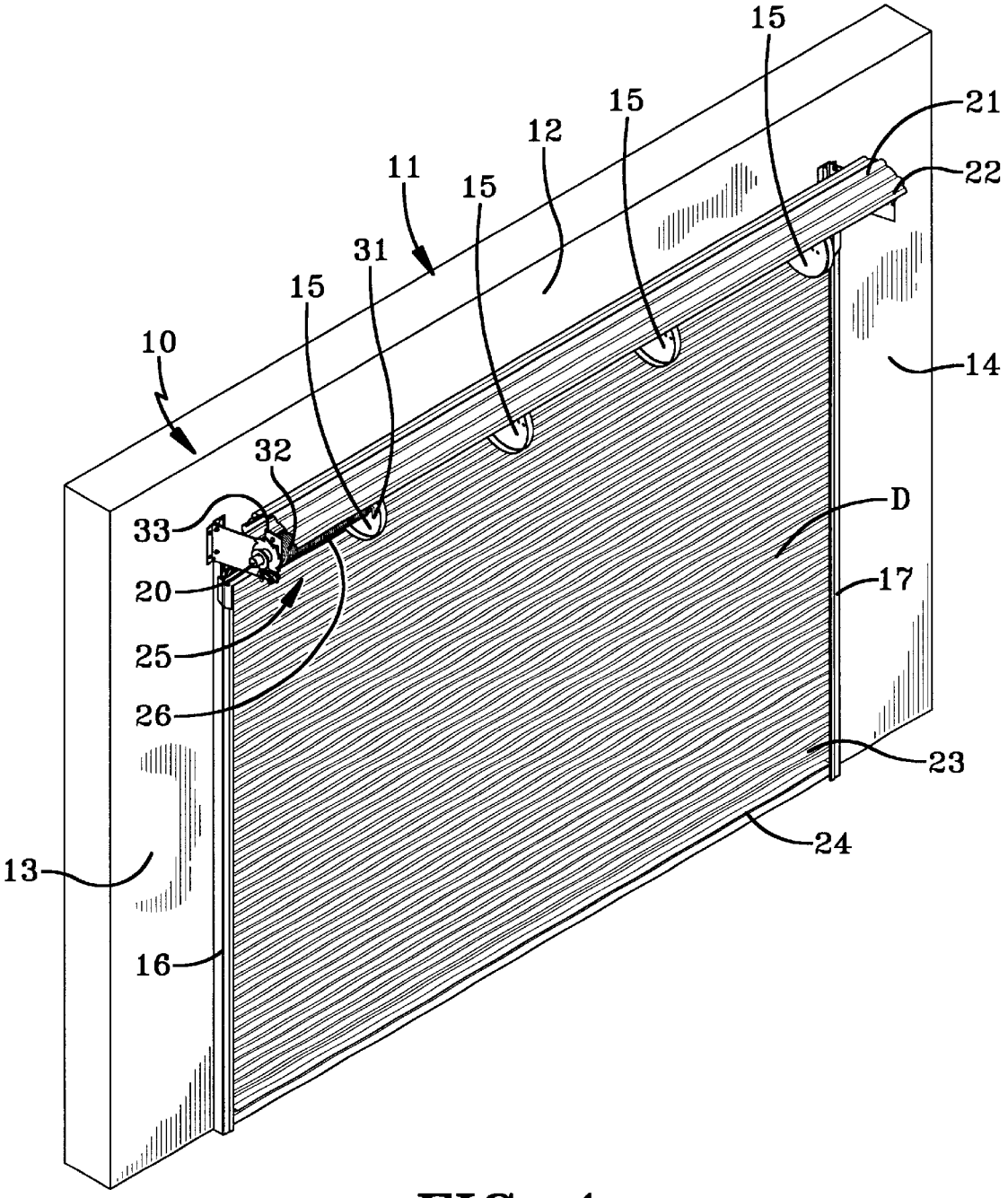
FIG. 1 is a rear perspective view of a rolling door located within an opening defined in a building and having a counterbalance system operative to provide a balancing force for the weight of the door and a tensioner according to the concepts of the present invention attached to one end of the counterbalance system to adjust and retain the force applied to the door by the counterbalance assembly.
Figure 3:
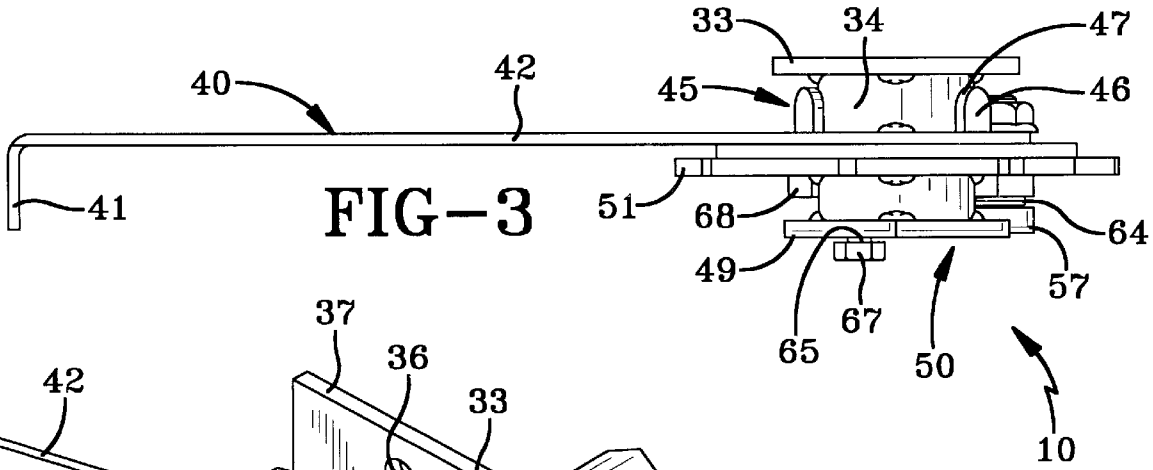
FIG. 3 is a top plan view of the tensioner with the axle removed as seen in FIG. 2 depicting a spacing assembly having a plurality of tabs that provide a clearance for rotation of a spring holder.

A door tensioner according to the concepts of the present invention is shown in the accompanying figures, and generally referred to by the numeral 50. The tensioner 50 is used in connection with a door assembly, generally referred to by the numeral 10, that includes a framework 11 made up of a header 12 and a pair of jambs 13, 14, having vertical guides 16, 17, which receive door D, mounted thereon. This framework 11 defines an opening in which the door D is selectively moved from a closed position depicted in FIG. 1 to an open position (not shown) where the door D is fully retracted and coiled about a plurality of drum wheels 15 located adjacent the header 12 of door D. The drum wheels 15 are attached to an axle 20 rotatably supported adjacent header 12 in a position above the opening.

The door D may be constructed of a plurality of panels 21 including a top panel 22 and a bottom panel 23. A bottom bar 24 may be attached to the bottom panel 23 to protect the bottom panel 23 against impact with a floor or objects interposed between the door D and the floor. The bottom bar 24 may be formed with a ridge handle, or other member (not shown) that is easily grasped to raise and lower the door D.

The door D is suitably attached to the drum wheels 15 such that upon opening the door D, the door panels 21 are sequentially coiled around the drum wheels 15 to store the door D in a compact fashion above the opening. To facilitate raising and lowering of the door D, one or more counterbalance assemblies, generally indicated by the numeral 25, may be employed to offset the weight of the door D. The counterbalance assembly 25 may include a spring 26 constructed of suitable resilient material such as steel, for applying a torsional force to the door D. As shown, spring 26 may be a coil spring located generally coaxially of and surrounding axle 20. Spring 26 is attached at its first end 32 to a retainer which may be in the form of an aperture 36 in spring holder 33 and at its second end 31 to one of the drum wheels 15 or axle 20, directly or by clips or fasteners. Alternatively, the ends 31, 32 of spring 26, spring holder 33 or drum wheel 15 may be rotatable about axle 20 such that one end of spring 26 is attached to the axle 20 and the other attached to the drum wheel 15 or spring holder 33 such that tension is applied to the spring 26 by rotating the one end relative to the end attached to the drum wheel 15 or spring holder 33, as by turning axle 20. In this way, relative rotation of the ends 31, 32 of spring 26 may be used to develop or release the torsional forces imposed by spring 26. To allow spring holder 33 to rotate relative to the drum wheel 15, spring holder 33 is supported on a sleeve 34 having a bore sized to fit over the axle 20. The sleeve 34 may be of greater dimension than axle 20 to accommodate a bearing 38, such as an oil-impregnated collar, fitted within sleeve 33 to journal axle 20, thereby reducing wear or friction.

The axle 20 and sleeve 34 are supported by a support bracket, generally indicated by the numeral 40. Support bracket 40 includes a mounting flange 41 suitably attached to the framework 1, or other supporting structure as by cap screws, and an axle supporting portion 42 projecting rearwardly of the frame 11. Axle supporting portion 42 has an opening 43, receiving sleeve 34 and axle 20. The opening 43 is sized such that sleeve 34 is free to rotate therein. As best shown in FIG. 1, a portion of sleeve 34 may protrude axially outward of support bracket 40 to receive a tool used to rotate sleeve 34, as described below. Also, axle 20 may extend beyond sleeve 34 and be axially fixed by a pin 39 that abuts the edge of sleeve 34. To provide an additional surface against which the pin 39 rests, sleeve 34 may be provided with an annular plate or washer (FIG. 1) adjacent the pin 39.

Figure 5:
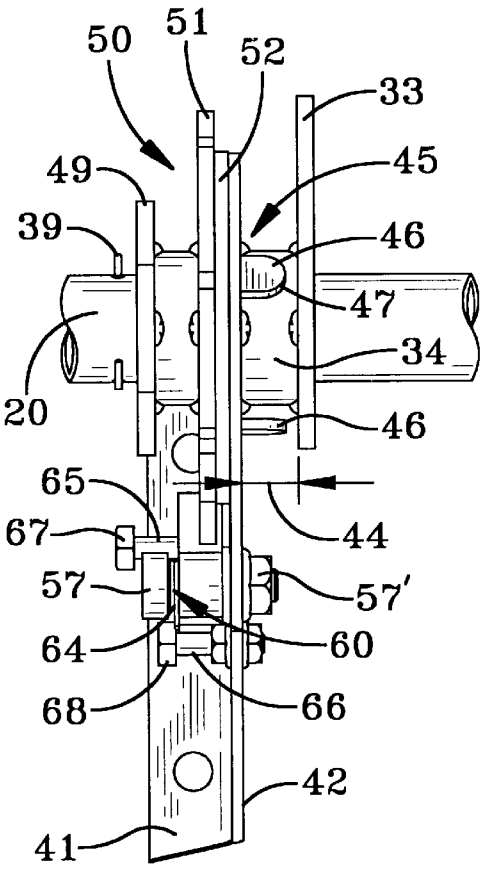
FIG. 5 is a front elevational view of the tensioning assembly seen in FIG. 2 depicting the spatial relationship of the spring holder and gear with the support bracket.
Figure 6:
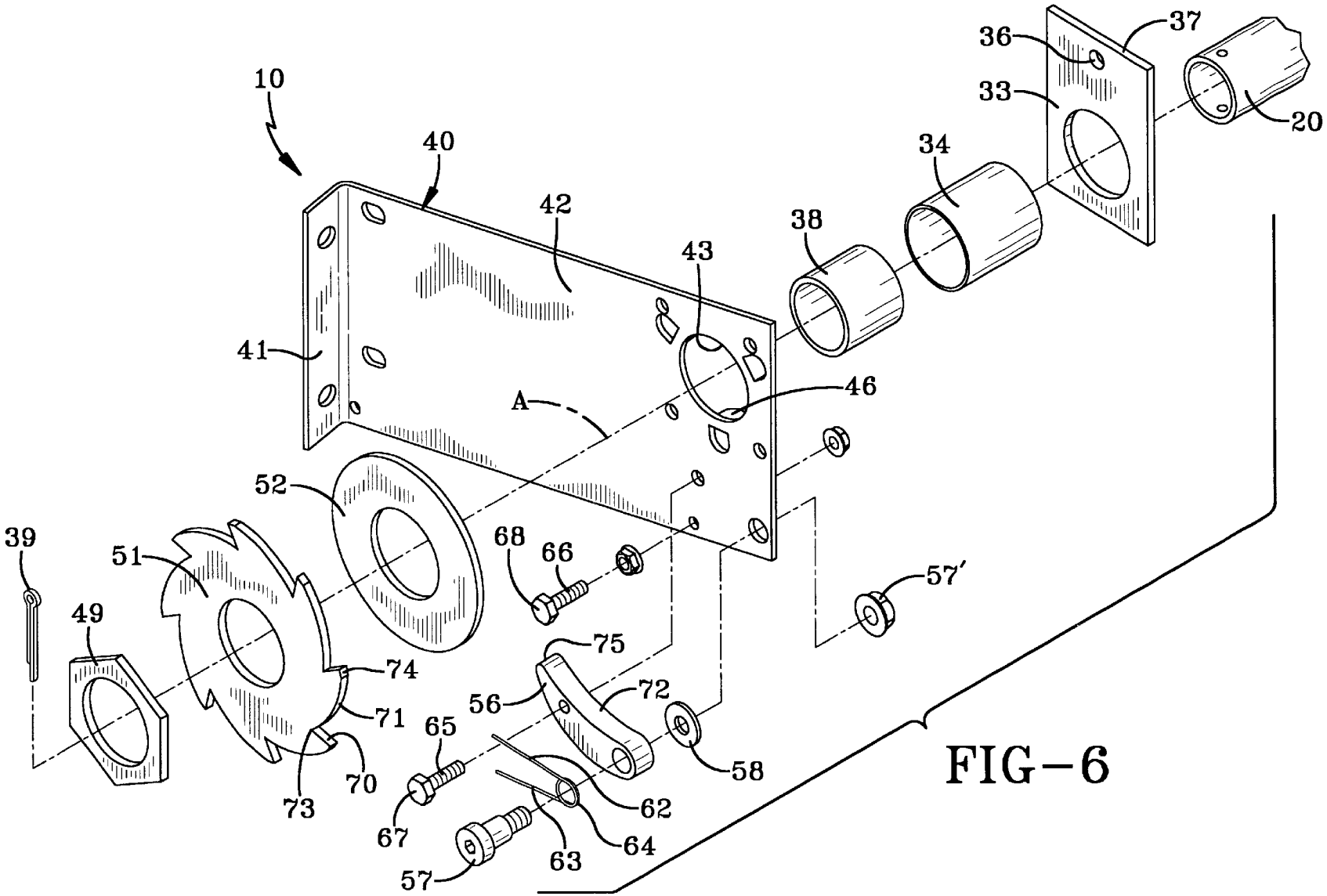
FIG. 6 is an exploded view of the tensioning assembly seen in FIG. 1 depicting the interrelationship of the tensioner components and the support bracket.

To provide a clearance 44 between the axle supporting portion 42 of bracket assembly 40 and the spring holder 33 as well as any fastener or portion of the spring protruding beyond the spring holder 33 toward bracket 40, a spacing assembly, generally indicated by the numeral 45, may be placed between the spring holder 33 and bracket assembly 40. As shown in FIG. 5, spacing assembly 45 may include a plurality of tabs 46 that extend axially inward from the axle supporting portion 42 of bracket assembly 40. As shown, tabs 46 may be placed in circumferentially spaced relation around opening 43. As best shown in FIG. 6, three tabs 46 may be arranged in a triangular pattern to act as a stop for axial movement of the spring holder 33. It will be appreciated that one or more members may be used to perform the same function, such as a single annular ridge, or multiple members that extend from support portion 42. The tabs 46 are preferably radially spaced away from opening 43 to provide radial clearance for the sleeve 34 to avoid interference of tabs 6 with the free rotation of sleeve 34. Tabs 46 may be punched from the axle supporting portion 42 of bracket assembly 40 and constructed to provide minimal contact with spring holder 33. As best shown in FIGS. 5 and 6, tabs 46 may be provided with rounded ends 47 to reduce any frictional forces that might develop in the event of contact between the tabs 46 and spring holder 33. Since the sleeve 34 and attached spring holder 33 may be rotated independently of axle 20, spring holder 33 may be rotated to adjust the counterbalancing force generated by spring 26. In this respect, spring holder 33 may be rotated with a wrench or rods in a manner known to those of ordinary skill in the art. To further facilitate rotation of the spring holder 33, a hex plate 49 or other grippable surface may be attached to the sleeve 34.

A tensioner assembly, generally indicated by the numeral 50, is provided or interrelates with the sleeve 34 and spring holder 33 to adjust and maintain the tension of spring 26. The tensioner assembly 50 includes a gear wheel 51 supported on sleeve 34 and rotatable therewith. To provide clearance for the free rotation of gear wheel 51 relative to bracket assembly 40, a suitable spacer 52, such as a washer, may be located between gear wheel 51 and bracket assembly 40. Spacer 52 may aid in reducing friction between the bracket assembly 40 and gear wheel 51 and further reduce the likelihood of interference between these two members.

Gear wheel 51 includes a plurality of radially projecting teeth 53 that define notches 54 therebetween. Teeth 53 interrelate with a pawl assembly, generally indicated by the numeral 55, to incrementally lock the position of spring holder 33 against the uncoiling force of spring 26. While the gear wheel 51 is shown with eight teeth 53, the number of teeth 53 may be increased or decreased depending on a desired tensioning increment. The tensioning increment, in terms of one revolution of gear 51, is essentially inversely proportional to the number of teeth 53. In the embodiment shown, the eight (8) teeth result in a tensioning increment of ⅛ of a revolution. Pawl assembly 55 interacts with the teeth 53 and notches 54 to selectively hold the gear wheel 51 against the uncoiling force of spring 26. Pawl assembly 55 includes a pawl 56 pivotally mounted to the axle supporting portion 42 of bracket assembly 40, as by a bolt 57 and nut 57'. Pawl 56 may be located on support bracket 40 such that its pivot is offset from a center line of axle 20 and the circumference traced by teeth 53. In this circumstance, pawl 56 may extend from pivot 57 at an acute angle from a horizontal line passing through the center of the pivot 57. If pawl 56 is curved, as shown, the angle of pawl 56 would vary with the increasing slope of the interior surface 72 of pawl 56. In assembling the gear 51 and pawl 56, suitable spacers 58 such as washers may be used to insure proper axial alignment of the pawl 56 and teeth 53. The interaction of the pawl 56 with teeth 53 to lock the position of spring holder 33 causes the tensioning increment to act as a lower limit on the amount of adjustment the installer may make in tensioning spring 26.

Figure 2:
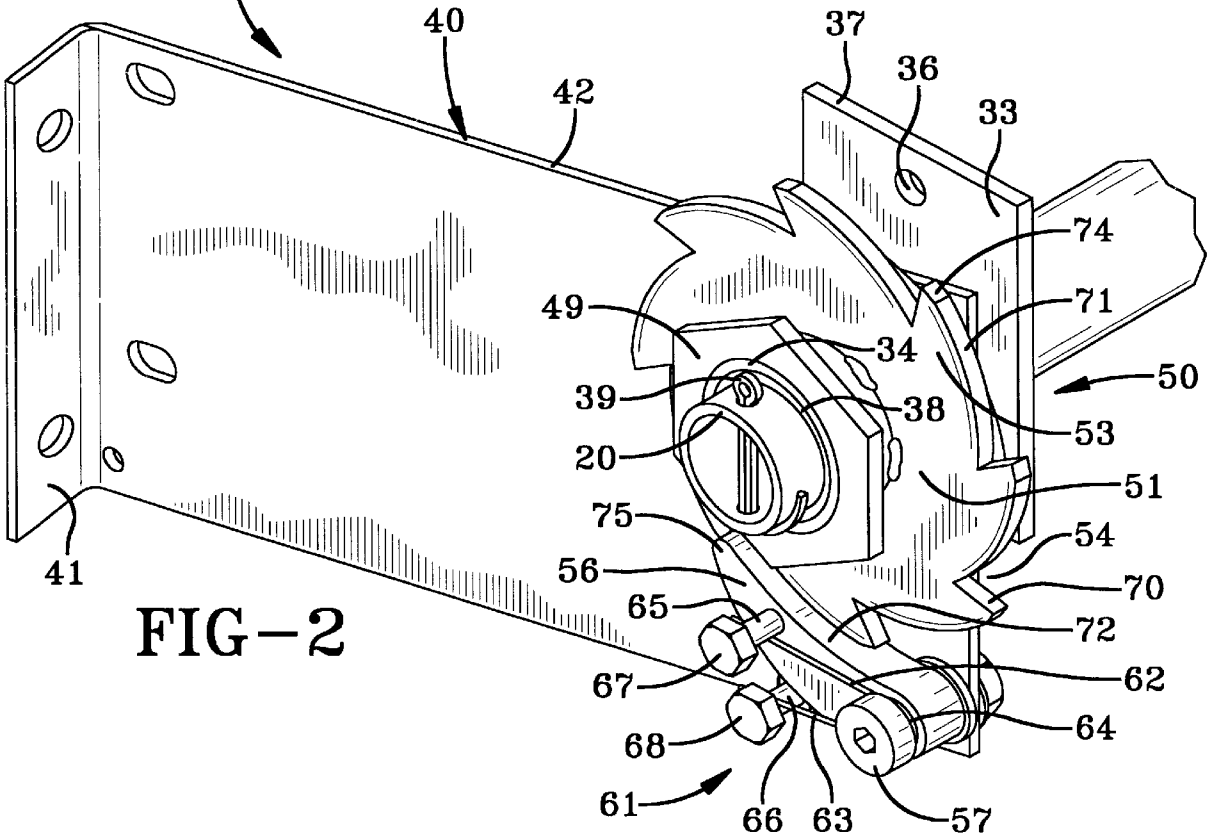
FIG. 2 is an enlarged perspective view depicting the support bracket and tensioner to the left of the door as seen in FIG. 1 depicting details of the tensioner including a spring holder and a gear supported on an axle tube on either side of a support bracket, and a pawl pivotally attached to the support bracket, and biased into locking engagement with the gear by a biasing member to prevent rotation of the spring holder.
Figure 4:
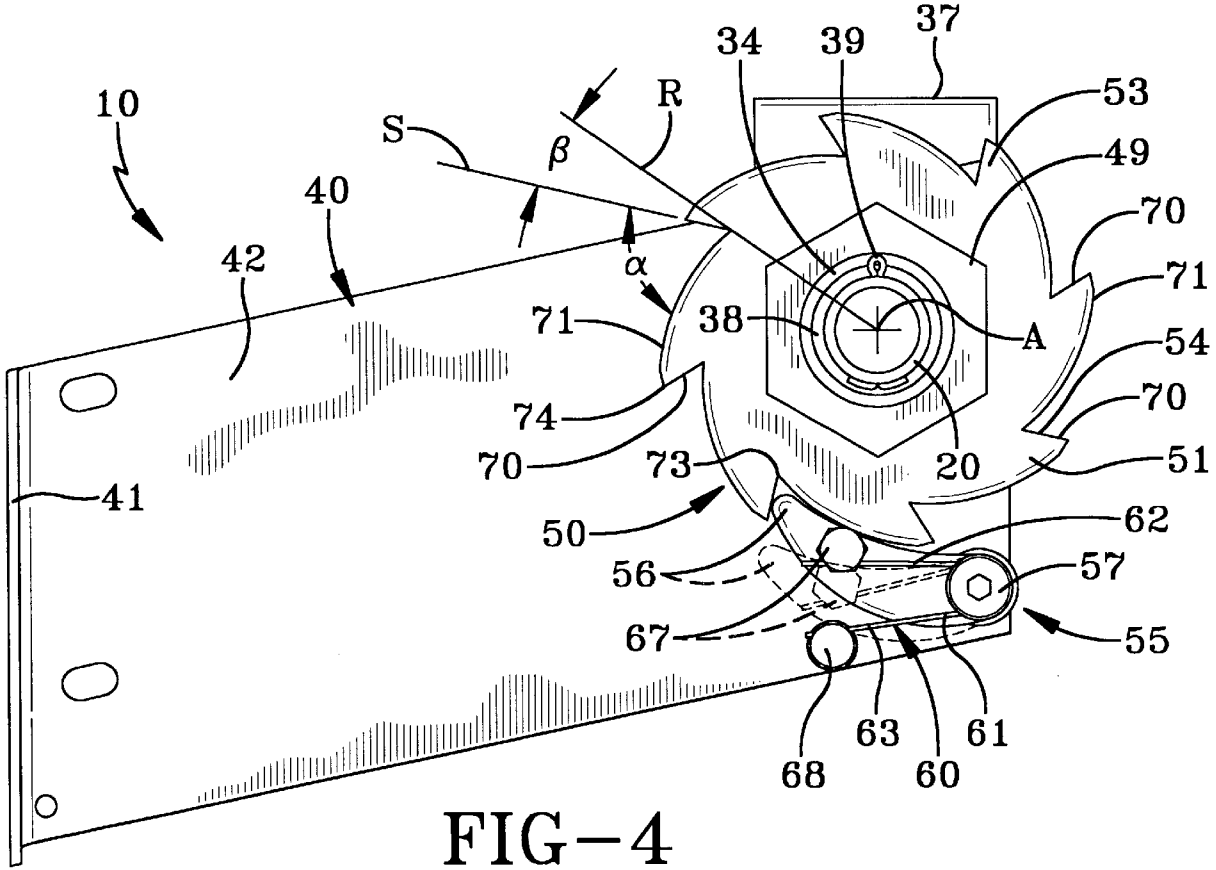
FIG. 4 is a left side elevational view of the tensioner seen in FIG. 2 depicting the tensioner supported on a support bracket where the tensioner includes a gear supported on a sleeve and a pawl biased into locking engagement with the gear, the engaged position of the pawl, which prevents the gear from rotating, being shown in solid lines with a disengaged position of the pawl, allowing free rotation of the gear, being shown in chain lines.

To automatically lock the tensioning assembly 50, the pawl 56 may be biased into an engaged position with gear 51, as shown in solid lines in FIG. 4. The pawl 56 may be biased by gravity or a biasing assembly, generally indicated by the numeral 60, which includes a biasing member, such as spring 61. In the embodiment shown in FIG. 4, spring 61 exerts an upward force on pawl 56 to drive it into an engaged position (solid lines) by means of opposed first and second legs 62, 63 extending from a wound vertex 64. As best shown in FIG. 2, the spring 61 may be axially located by bolt 57, which forms a pivot for pawl 56. As best seen in FIGS. 2 and 6, the shank of bolt 57 is sized to fit through wound vertex 64 and into a bore formed in pawl 56. Bolt 57 may be secured to support bracket 40, as by the nut 57'. Once secured, the head of bolt 57 traps vertex 64 against pawl 56. The extending legs 62, 63 of spring 61 are compressed between a pair of projections 65, 66. Projections 65, 66 extend axially outward from pawl 56 and the axle supporting portion 42 of bracket assembly 40, respectively. Projections 65, 66 may be formed on their respective members, fastened thereto, or formed by fasteners, such as caps screws 67, 68. Projections 65, 66, in general, may be of any configuration shape, or size suitable for capturing the ends of biasing member 61. As shown, cap screws 67, 68, which form projections 65, 66, extend a sufficient distance such that, they may provide fingerholds for manual or tool-assisted actuation of the pawl 56, as described below.

Since the pawl 56 is biased into an engaged position, it will be appreciated that to release the pawl 56, the installer may squeeze first projection 65 toward second projection 66 to urge the pawl 56 toward a disengaged position, shown in broken lines in FIG. 4, where the pawl has cleared the adjacent tooth 53. With the pawl 56 disengaged, the gear 51 is free to rotate. With the gear 51 released, the installer may adjust the tension on spring 26 by rotating spring holder 33 in the appropriate direction. Upon reaching the desired tension, the pawl 56 may be released allowing bias assembly 60 to return the pawl 56 to the solid line engaged position.

Each tooth 53 of gear 51 is provided with a stop face 70 that engages the pawl 56. The stop face 70 is disposed such that it interrelates with the pawl 56 in reaching a state of equilibrium, when the pawl 56 is engaged. In addition to manually disengaging pawl 56 by means of the projections 65, 66, rotation of gear 51 in a direction that moves the stop face 70 away from pawl 56, in this case a clockwise rotation, may be used to periodically displace pawl 56 out of engagement with the passage of each tooth 53. A run face 71 connects successive stop faces 70 providing a surface along which the pawl 56 rides during rotation of gear wheel 51. The run face 71 and stop face 70 join each other at a vertex 73, and, from this point, run face 71 slopes radially outward and away from stop face 70. Run face 71 reaches a peak 74 corresponding to the radial height of stop face 70. In this way the interior surface 72 of pawl 56 rides along run surface 71 in a cam-follower fashion. The slope of run face 71 displaces pawl 56 radially outward of its contact position against stop face 70 to remove the pawl 56 from the engaged position and prepare the pawl for the successive locking motion, where the pawl 56, under the urging of biasing assembly 60, is driven into the next notch 54. This locking motion may be characterized by an audible "click"as the pawl 56 is snapped into place, informing the installer that the pawl 56 has attained the engaged position and that the gear wheel 51 has traveled one tensioning increment.

In the embodiment shown, to facilitate the cam follower interaction of the gear 51 and pawl 56, the run face 71 of gear 51 and interior surface 72 of pawl 56 are made nonlinear or arcuate such that pawl 56 extends in an arcuate fashion toward teeth 53. The profile of interior surface 72 of pawl 56 may generally correspond to the run face 71 to provide smoother interrelation of the pawl 56 and gear wheel 51. As shown, these surfaces 71, 72 may be elongated to gradually move the pawl 56 out of engagement with the stop surface 70 of tooth 53 as the gear wheel 51 is rotated. Relative to the plane S of the stop face 70, run face 71 may initially extend in a non-linear fashion, which may be exponential, through a varying angle a toward the peak 74 of tooth 53. Stop face 70 may radially extend inward from peak 74 such that it is disposed generally perpendicular to the pawl 56 upon contact. Alternatively, the stop face 70 may extend inwardly from peak 74 toward a radial line R extending through the vertex 73 to create an acute angle between the adjacent run face 71. In this fashion, stop face 70 is "undercut", signifying that stop face 70 is disposed at an acute angle β relative to radial line R. The undercut stop face 70 helps to draw the pawl 56 radially inward as the gear wheel 51 rotates. Further, the angle β of stop face 70 serves to provide positive resistance against unintentional release or outward displacement of pawl which might result from the torsional force of spring 26 acting on gear wheel 51. To adjust the tension on spring 26, gear wheel 51 may have a number of teeth 53 that provide separate points of adjustment for the counterbalance assembly 25. The embodiment depicted has eight teeth 53 allowing the gear wheel 51 or spring holder 33 to be rotated in one-eighth increments of a complete rotation. As will be appreciated, fewer teeth 53 may be used for coarser incrementation and additional teeth 53 may be added to provide finer adjustment of the counterbalancing force.

Once suitable counterbalancing force has been achieved in the counterbalance assembly, to prevent tampering which could cause unintentional release of the counterbalancing force, a locking assembly, generally indicated by the numeral 65, may be used to prevent the spring holder 33 from rotating. To that end, either of the gear wheel 51 or pawl 56 maybe locked in place by locking assembly 65, such that gear wheel 51 and connected spring holder 33 are not free to rotate. Locking assembly 65 may include a lock member that is not easily removed to guard against a user from pulling the member out by hand or having the member come free when jarred or under the influence of vibration within the structure. Suitable lock members might include a Zip-tie or similar device or a fastener, such as a cap screw 67 may be inserted through pawl 56 and into bracket assembly 40 to prevent the pawl 56 from moving out of the engaged position. In that way, the installer may secure the cap screw 67 into a threaded bore 68 in support bracket 40 or a nut, such that an average person would not be able to accidentally remove the cap screw 67 or otherwise release gear 51. This helps eliminate accidental release of the counterbalance assembly 25 and discourages tampering with the tensioning assembly 50. In operation, tensioner 50 automatically retains the position of spring holder 33 and accordingly tension on counterbalance assembly 25 by biasing pawl assembly 55 into locking engagement with gear wheel 51. The device 50 may be assembled as shown in FIG. 6 with the gear wheel 51 and spring holder 33 located on opposite sides of support bracket 40. The counterbalance spring 26 of door assembly 10 is attached to the spring holder 33, as by a nut and bolt. In the embodiment shown, to increase force upon the counterbalance assembly 25, the user would apply a force to hex plate 49 or sleeve 34 using pliers, a pipe wrench, or rods, which may be inserted through sleeve 34 or other tools known in the art. Once the force of counterbalance assembly 25 is overcome, the gear wheel 51 of tensioner assembly 50 would rotate past pawl assembly 55. Pawl 56 of pawl assembly 55 would follow the contour of gear wheel 51 in a cam follower-type fashion. As each tooth 53 passes pawl 56, the pawl 56 "clicks" down to the next gear tooth 53. Once the user stops applying a tensioning force, the force of the counterbalance assembly 25 would cause the gear wheel 51 to rotate in the opposite direction. Under the force of biasing assembly 60, pawl 56 continues to follow the contour of the gear wheel 51 until the pawl 56 encounters the stop surface 70 of tooth 53, at which point the counterbalancing force of the counterbalance assembly 25 is held relative to the support bracket 40 by pawl 56. To reduce the counterbalancing force within counterbalance assembly 25, the user would release pawl 56, as by squeezing cap screws 67, 68 together. Once the pawl 56 is released, the user slowly reduces the applied force until the gear wheel 51 of tensioner 50 begins to turn in the direction appropriate to reduce the counterbalancing force. Once sufficiently reduced, the installer would return the pawl 56 to the engaged position, as by simply releasing cap screw 67 to allow the pawl 56 to engage an adjacent notch 54 as urged by biasing assembly 60. Once the appropriate counterbalancing force is achieved within the counterbalance assembly 25, the installer may lock tensioner 50 with a locking assembly, such as by driving cap screw 67 into support bracket 40 to lock the pawl 56 in place to prevent tampering with the tensioner 50.

In light of the foregoing, it should be apparent that the invention as described and shown provides a new and useful improvement in the art. It should further be noted that various modifications and substitutions may be made in the present invention without deviating from the spirit thereof. Thus, for an appreciation of the scope of the present invention, reference should be made to the following claims.

What is claimed is:

1. A tensioner in a rolling door system, the rolling door system having a door operatively attached to at least one wheel supported on an axle, the axle being rotatably supported on a pair of support brackets, said support brackets each defining a bore through which the axle is received and a counterbalance assembly that generates a counterbalancing force, the counterbalance assembly having a first end attached to the door and a second end attached to the tensioner, the tensioner comprising, a sleeve that fits over an end of the axle and is rotatably supported in said bore of one of said support brackets, a spring holder and a gear wheel attached to said sleeve, wherein the second end of the counterbalance assembly attaches to said spring holder, said gear wheel having a plurality of teeth defining a plurality of notches therebetween, said teeth being undercut against the direction of the counterbalancing force, a pawl movable between a disengaged position and an engaged position, said pawl rotatably retaining said gear wheel when in said engaged position, said pawl being biased toward said engaged position, whereby said pawl automatically engages said gear wheel to retain the counterbalancing force imparted by said counterbalance assembly to balance the weight of the door.

2. The tensioner of claim 1 further comprising, a biasing assembly including a biasing member urging said pawl toward said engaged position.

3. The tensioner of claim 2, wherein said biasing member is a spring.

4. The tensioner of claim 2, wherein said pawl is pivotally attached to said support bracket.

5. The tensioner of claim 4 further comprising, a first projection extending from said pawl and a second projection extending from said support bracket, wherein said second projection is fixed relative to said pawl; said biasing member acting on said projections to urge said pawl into said engaged position.

6. The tensioner of claim 5, wherein said biasing member is a spring.

7. The tensioner of claim 6, wherein said pawl is attached to said support bracket at a pivot, said spring having a fixed vertex and a first leg and a second leg extending from said vertex, wherein said first and second legs are compressed between said projections to urge said pawl toward said engaged position.

8. The tensioner of claim 7, wherein said vertex is located coaxially with said pivot.

9. The tensioner of claim 8 further comprising, a locking member selectively attaching said pawl to said support bracket to lock said pawl in the engaged position.

10. The tensioner of claim 9, wherein said locking member includes a fastener attaching said pawl to said support bracket.

11. The tensioner of claim 9, wherein said fastener is carried on said pawl, whereby said fastener is selectively driven into said support bracket to lock said pawl thereto.

12. A rolling door comprising, an axle supported by end brackets, a plurality of drum wheels mounted on said axle, a multi-section door adapted to be selectively rolled and unrolled about said drum wheels, a gear wheel mounted on said axle proximate to one of said end brackets, a spring retainer associated with said gear wheel, a torsion spring having a first end operatively attached to the multi-section door and a second end attached to said spring retainer, a pivotally mounted pawl selectively engaging said gear wheel to maintain a selected counterbalance force setting and disengaging said gear wheel to permit adjustment of the counterbalance force setting, and a locking assembly carried on said pawl selectively engageable with said support bracket to lock said pawl in an engaged position.

13. A rolling door according to claim 12 further comprising, a biasing assembly urging said pawl toward said engaged position.

14. A rolling door according to claim 13, wherein said biasing assembly includes a spring.

15. A rolling door according to claim 12, wherein said gear wheel includes at least one tooth, said tooth having a stop face engageable with said pawl to maintain said gear wheel in the selected engaged position and a run face, said run face having a non-linear profile, said pawl having an inner surface having a profile corresponding to said run face such that said run face selectively displaces said pawl radially outward in a non-linear fashion.

16. A rolling door according to claim 12, wherein said gear wheel is attached to a sleeve mounted on said axle and said spring retainer is located on a spring holder.

17. A rolling door according to claim 16, wherein said sleeve extends through a bore in one of said end brackets and said one of said end brackets is interposed between said gear wheel and said spring holder.

18. A rolling door comprising, an axle supported by end brackets, a plurality of drum wheels mounted on said axle, a multi-section door adapted to be selectively rolled and unrolled about said drum wheels, a sleeve rotatable on said axle, a gear wheel attached to said sleeve, a spring retainer associated with said gear wheel, a torsion spring having a first end attached to said multi-section door and a second end attached to said spring retainer, a pivotally mounted pawl selectively engaging said gear wheel to maintain a selected counterbalance force setting and disengaging said gear wheel to permit adjustment of the counterbalance force setting, and a locking assembly carried on said pawl selectively engageable with said support bracket to lock said pawl in an engaged position.

19. A rolling door according to claim 18 further comprising, a biasing assembly urging said pawl toward said engaged position.

20. A door assembly comprising an axle supported by end brackets, a multi-section door adapted to be selectively moved upwardly and downwardly relative to said axle, a tensioner associated with said axle, a torsion spring having a first end operatively attached to said multi-section door and a second end operatively attached to said tensioner, said tensioner including a gear wheel having a plurality of teeth, said teeth having an undercut stop face and an arcuate run face disposed between said stop face of adjacent of said teeth, and a pivotally mounted pawl selectively engaging said stop face to maintain a selected counterbalance force setting.

21. A door assembly according to claim 20, wherein said teeth have a peak at one end of said undercut stop face and a vertex at another end to define a notch, whereby said arcuate run face selectively displaces said pawl from said notch.

22. A door assembly according to claim 20, wherein said pawl has a non-linear radially interior surface that substantially corresponds to said run face.

23. A tensioner in a door system, the door system having an upwardly opening door operatively attached to an axle, the axle being rotatably supported on a pair of support brackets, said support brackets each defining a bore through which the axle is received and a counterbalance assembly that generates a counterbalancing force, the counterbalance assembly having a first end attached to the axle and a second end attached to the tensioner, the tensioner comprising, a sleeve that fits over an end of the axle and is rotatably supported in said bore of one of said support brackets, a spring holder and a gear wheel attached to said sleeve, wherein the second end of the counterbalance assembly attaches to said spring holder, said gear wheel having a plurality of teeth defining a plurality of notches therebetween, said teeth being undercut against the direction of the counterbalancing force, a pawl movable between a disengaged position and an engaged position, said pawl rotatably retaining said gear wheel when in said engaged position, said pawl being biased toward said engaged position, whereby said pawl automatically engages said gear wheel to retain the counterbalancing force imparted by said counterbalance assembly to balance the weight of the door.

24. An upwardly opening door comprising, an axle supported by end brackets, a gear wheel mounted on said axle proximate to one of said end brackets, a spring retainer associated with said gear wheel, a torsion spring having a first end operatively attached to the door and a second end attached to said spring retainer, a pivotally mounted pawl selectively engaging said gear wheel to maintain a selected counterbalance force setting and disengaging said gear wheel to permit adjustment of the counterbalance force setting, and a locking assembly carried on said pawl selectively engageable with said support bracket to lock said pawl in an engaged position.

25. A door according to claim 24 further comprising, a biasing assembly urging said pawl toward said engaged position.

26. A door according to claim 24, wherein said gear wheel includes at least one tooth, said tooth having a stop face engageable with said pawl to maintain said gear wheel in the selected engaged position and a run face, said run face having a non-linear profile, said pawl having an inner surface having a profile corresponding to said run face such that said run face selectively displaces said pawl radially outward in a non-linear fashion.

27. A door according to claim 24, wherein said gear wheel is attached to a sleeve mounted on said axle and said spring retainer is located on a spring holder.

28. A door according to claim 27, wherein said sleeve extends through a bore in one of said end brackets and said one of said end brackets is interposed between said gear wheel and said spring holder.

29. An upwardly opening door comprising, an axle supported by end brackets, a gear wheel attached to said sleeve, a spring retainer associated with said gear wheel, a torsion spring having a first end attached to said axle and a second end attached to said spring retainer, a pivotally mounted pawl selectively engaging said gear wheel to maintain a selected counterbalance force setting and disengaging said gear wheel to permit adjustment of the counterbalance force setting, and a locking assembly carried on said pawl selectively engageable with said support bracket to lock said pawl in an engaged position.

30. A door according to claim 29 further comprising, a biasing assembly urging said pawl toward said engaged position.

31. A tensioner in a rolling door system according to claim 1, wherein one of said support brackets has a spacing assembly for maintaining said spring holder spaced from said one of said support brackets.

32. A tensioner in a rolling door system according to claim 31, wherein said spacing assembly is a plurality of tabs formed in said one of said support brackets extending axially toward said spring holder.

* * * * *